US007323279B2

(12) United States Patent
Kato et al.

(10) Patent No.: US 7,323,279 B2
(45) Date of Patent: Jan. 29, 2008

(54) ONE-COMPONENT MAGNETIC TONER FOR DEVELOPING AN ELECTROSTATIC CHARGE IMAGE, PROCESS CARTRIDGE, AND METHOD FOR RECYCLING THE PROCESS CARTRIDGE

(75) Inventors: Kazunori Kato, Tokyo (JP); Shuichi Aita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 616 days.

(21) Appl. No.: 10/891,060

(22) Filed: Jul. 15, 2004

(65) Prior Publication Data

US 2005/0048386 A1 Mar. 3, 2005

(30) Foreign Application Priority Data

Jul. 16, 2003 (JP) ..... 2003-198069

(51) Int. Cl.
*G03G 9/083* (2006.01)

(52) U.S. Cl. ..... 430/106.1; 430/111.41

(58) Field of Classification Search ..... 430/106.1, 430/106.2, 111.41
See application file for complete search history.

(56) References Cited

U.S. PATENT DOCUMENTS 4,329,415 A * 5/1982 Ikeda et al. ..... 430/106.2
4,989,044 A 1/1991 Nishimura et al. ..... 355/251
6,154,625 A * 11/2000 Saiki et al. ..... 430/123.3
6,251,555 B1 * 6/2001 Hayashi et al. ..... 430/106.2

FOREIGN PATENT DOCUMENTS

| | | |
|---|---|---|
| JP | 01-276174 | 11/1989 |
| JP | 07-281517 | 10/1995 |
| JP | 11-084714 | 3/1999 |
| JP | 11-143121 | 5/1999 |
| JP | 11-174729 | 7/1999 |

* cited by examiner

*Primary Examiner*—Janis L. Dote
(74) *Attorney, Agent, or Firm*—Fitzpatrick, Cella, Harper & Scinto

(57) ABSTRACT

The present invention provides a one-component magnetic toner for developing an electrostatic charge image, which do not cause an image defect by toner aggregation or fusion even though a device is miniaturized and the processing speed of the device is accelerated, and which allows easy recycling of a toner cartridge. The one-component magnetic toner for developing an electrostatic charge image of the present invention is one comprising: toner particles comprising fine magnetic particles (A) and a binder resin; and fine magnetic particles (B) externally added to the toner particles, in which the maximum permeability ($\mu m_A$) of the fine magnetic particles (A) contained in the toner particles and the maximum permeability ($\mu m_B$) of the fine magnetic particles (B) externally added to the toner particles satisfy a relationship represented by the following formula (1)

$$\mu m_B/\mu m_A \leqq 1.8 . \quad (1)$$

2 Claims, 2 Drawing Sheets

ONE-COMPONENT MAGNETIC TONER FOR DEVELOPING AN ELECTROSTATIC CHARGE IMAGE, PROCESS CARTRIDGE, AND METHOD FOR RECYCLING THE PROCESS CARTRIDGE

BACKGROUND OF THE INVENTION

1. Field of the Invention

The present invention relates to a one-component magnetic toner for developing an electrostatic charge image for use in electrophotography.

2. Description of the Related Art

In recent years, a dry-developing process in an electrostatic copying system has been not only applied on copying machines as has been conventionally done but also expanded to the fields of personal uses of printers, facsimile machines, and complex machines. thereof with copying machines. Therefore, small-sized and light-weighted versions of such machines have been strongly demanded. In addition, because of the rapid market expansion of personal-use image-input devices as typified by digital videos and digital cameras, their image-output devices have been desired to form images with higher quality than ever before.

Furthermore, from the viewpoint of pressing greater emphasis on environmental issues, the designs of the device and toner cartridge that allow their recycling have been requested more severely to realize power-saving or cycling consumer society.

For addressing those requests, various improvements on image-forming methods or new developments thereof have been studied and tried.

Dry development systems in the various kinds of electrostatic copying system practically used in the art include a two-component developing system using a toner and a carrier such as an iron powder and a one-component developing system without using such a carrier. Among them, the two-component developing system is one used most widely. However, such a system has a disadvantage in that a developer deteriorates as the particles of toner adhere on the surface of a carrier. Further, in the two-component developing system, only the toner is consumed, resulting in a decrease in content of the toner in the developer; therefore, it is difficult to keep the mixing ratio of the carrier and the toner constant. As a result, there is a disadvantage in that the developing device will be grown in size.

On the other hand, the above disadvantages cannot be found in the one-component developing system because no carrier is used in the system. Thus, the one-component developing system is advantageous in, for example, miniaturization of the device. Furthermore, there are two types of one-component developing system: a non-magnetic one-component developing system using a non-magnetic toner and a magnetic one-component developing system using a magnetic toner. The non-magnetic one-component developing system is suitable for colorization because no magnetic substance is used in the toner. However, the non-magnetic one-component developing system retains a developer on a developer bearing member mainly by means of an electrostatic force caused by mutual frictional electrification between the developer bearing member and the developer. Thus, when the charge of the developer is low, problems of the fogging of a non-imaging part and causing the contamination of the inside of the device by toner scattering are easily caused. On the other hand, the magnetic one-component developing system is free from those problems because the development is performed while magnetic toner is retained on a developer bearing member provided with a magnetic field generator such as a magnet inside thereof. However, the one-component developing system tends to cause a developing ghost as a common problem thereof, compared with the two-component developing system.

Various attempts have been made for alleviating the problems described above. For instance, JP 01-276174 A and JP 07-281517 A disclose a method of forming a specific resin layer containing conductive fine particles and a method of forming a coating film made of a material mainly composed of Mo, O, and H on the surface of a developer bearing member, respectively. Surely, the charge-up of the toner can be inhibited using such a developer bearing member, and as a result the generation of a developing ghost can be prevented. However, when the developer bearing member constructed as described above is used, a problem in that the electrostatic property of the toner falls to result in low image density and unevenness in image density arises particularly in the case of image formation after leaving the toner under high-temperature and high-humidity conditions because the developer bearing member itself has an insufficient ability of imparting charges on the developer.

For simultaneously solving the problem of a developing ghost and the problems of low image density and unevenness in image density, methods using magnetic substances as external additives of toners have been known in the art. In other words, those methods attempt to solve the problems by using a magnetic substance having a specific particle size distribution (e.g., JP 11-084714 A), a magnetic substance having a specific configuration (e.g., JP 11-143121), and a magnetic substance subjected to a specific treatment (e.g., JP 11-174729) as the external additives of toners.

In fact, using those kinds of magnetic substances as the external additives of toners has alleviated the problems of a developing ghost, low image density, and unevenness in image density. In recent years, however, there is a need of providing a small-sized device with the properties of high-speed processing, power-saving, and high-definition, and with recycling-easy design. Therefore, various disadvantages have come to be pointed out as described below.

In the magnetic toner that contains a magnetic substance in toner particles, when an additional magnetic substance is used as an external additive, the magnetic substance externally added may be attached on the surface of toner particles mainly by Coulomb's force. Usually, the magnetic external additive stably exists on the surface of toner particles by the Coulomb's force. However, in the developing process, when the magnetic toner is retained in the neighborhood of a developer bearing member provided with a magnetic field generator such as a magnet inside thereof or retained on the developer bearing member, the difference between the toner particles containing the magnetic substance and the magnetic substance provided as the external additive may arise with respect to the extent of power caused by the magnetic field from the developer bearing member. If such a difference is great, as a result, the magnetic external additive cannot exist stably on the surface of toner particles and the magnetic external additive will exfoliate (be released) from the surface of toner particles and cause various troubles.

The phenomenon of releasing the magnetic external additive becomes a serious obstacle to make a small-sized developer bearing member to attain the miniaturization of the device and to design toner to provide the device with the properties of high-speed processing and power-saving and with recycling-easy design. In other words, when the release (exfoliation) of the magnetic external additive proceeds, the possibility of making a contact between the resin or wax component on the surface of toner and other toner particles or various members including the developer bearing member becomes large. The contact will result in aggregation between toner particles and fusion of toner particles to the various members, causing image defects such as white lines in an image. Those phenomena occur notably as the developer bearing member is miniaturized and accelerated. In addition, for fulfilling the requirement of higher image quality in recent years, attempts have been made for further miniaturizing the particle size of toner and the addition of an external additive having sophisticated functions to the toner. However, as the particles contained in the whole of toner become smaller or the content of small-sized particles increases, the above problems is becoming still more remarkable. Besides, troubles will be caused in the material design of toner, such as low-temperature fixing for power saving.

Furthermore, the small-sized particles such as the released magnetic external additive is then fixed on small irregular portions on the surface of the developer bearing member, provided with the magnetic field generator such as a magnet inside thereof, by means of the magnetic force, the frictional force between the developer bearing member and a toner-layer regulating member, or the like. For this reason, the toner may be of poor electrification in the developing process and disassembling and recycling a toner cartridge after the use thereof may require many steps. Therefore, the fixation will be a problem in view of a recycling-easy design.

SUMMARY OF THE INVENTION

The present invention has been made in consideration of the above problems and an object of the present invention is to provide a one-component magnetic toner for developing an electrostatic charge image, which does not cause an image defect by toner aggregation or fusion even though a developing device is miniaturized and the processing speed of the device is accelerated.

In addition, another object of the present invention is to provide a one-component magnetic toner for developing an electrostatic charge image, which can maintain high image quality without image fogging caused by toner even though a device is miniaturized and the processing speed thereof is accelerated.

Still another object of the present invention is to provide a one-component magnetic toner for developing an electrostatic charge image, which allows parts of a toner cartridge to be easily recycled when the cartridge is disassembled after the use thereof.

The inventors of the present invention have devoted themselves to studying the physical properties of a magnetic substance in a developer and found out that the above objects can be attained using a one-component magnetic toner having fine magnetic particles externally added thereto in which the maximum permeability ($\mu m_A$) of fine magnetic particles contained in toner particles and the maximum permeability ($\mu m_B$) of fine magnetic particles externally added to the toner particles satisfy a constant relationship between them. Furthermore, the inventors of the present invention have found out that more preferable effects can be obtained when the one-component magnetic toner contains a specific amount of small-sized particles. And they have completed the present invention.

According to one aspect of the present invention, there is provided a one-component magnetic toner for developing an electrostatic charge image, comprising: toner particles containing at least fine magnetic particles (A) and a binder resin; and fine magnetic particles (B) externally added to the toner particles, in which the maximum permeability ($\mu m_A$) of the fine magnetic particles (A) contained in the toner particles and the maximum permeability ($\mu m_B$) of the fine magnetic particles (B) externally added to the toner particles satisfy a relationship represented by the following formula (1).

$$\mu m_B/\mu m_A \leq 1.8 \quad (1)$$

According to another aspect of the present invention, there is provided a process cartridge removably attached to an electrophotographic apparatus, integrally including a developing device and at least one selected from the group consisting of an image bearing member, a cleaning member, and a charging member, in which the developing device comprises: a storage part for storing a developer; a developer bearing member having a non-magnetic sleeve having a magnet fixed in the non-magnetic sleeve to bear the developer on the non-magnetic sleeve; and a regulating member for regulating the amount of the developer born on the developer bearing member, which is provided so as to be in contact with the developer bearing member;

the developer is a one-component magnetic toner comprising toner particles containing at least fine magnetic particles (A) and a binder resin; and fine magnetic particles (B) externally added to the toner particles, and the maximum permeability ($\mu m_A$) of the fine magnetic particles (A) contained in the toner particles and the maximum permeability ($\mu m_B$) of the fine magnetic particles (B) externally added to the toner particles satisfy a relationship represented by the above formula (1).

According to still another aspect of the present invention, there is provided a method for recycling a process cartridge removably attached on an electrophotographic apparatus, integrally comprising a developing device and at least one selected from the group consisting of an image bearing member, a cleaning member, and a charging member, in which the developing device comprises: a storage part for storing a developer; a developer bearing member comprising a non-magnetic sleeve having a magnet fixed in the non-magnetic sleeve to bear the developer on the non-magnetic sleeve; and a regulating member for regulating the amount of the developer on the developer bearing member, which is provided so as to be in contact with the developer bearing member, the process cartridge, which is removed from the electrophotographic apparatus when the developer is used up or the process cartridge becomes unable to exhibit its desired performance, further comprises a means for accumulating or displaying information about a usage-history of the process cartridge, the method including the steps of:

cleaning or replacing the developing device or components that constitute the process cartridge, or supplying the developer to the developing device to recycle the process cartridge to be attached to the electrophotographic apparatus so as to be used again; and accumulating or displaying updated information about a usage-history the process cartridge on the means for accumulating or displaying the usage history before the recycling, in which the developer comprises: toner particles comprising at least fine magnetic particles (A) and a binder resin; and fine magnetic particles (B) externally added to the toner particles; and the maximum permeability ($\mu m_A$) of the fine magnetic particles (A) contained in the toner particles and the maximum permeability ($\mu m_B$) of the fine magnetic particles (B) externally added to the toner particles satisfy the relationship represented by the above formula (1).

BRIEF DESCRIPTION OF THE DRAWINGS

Other objects and advantages of the present invention will become apparent during the following discussion conjunction with the accompanying drawings, in which.

DETAILED DESCRIPTION OF THE PREFERRED EMBODIMENTS

Figure 1:
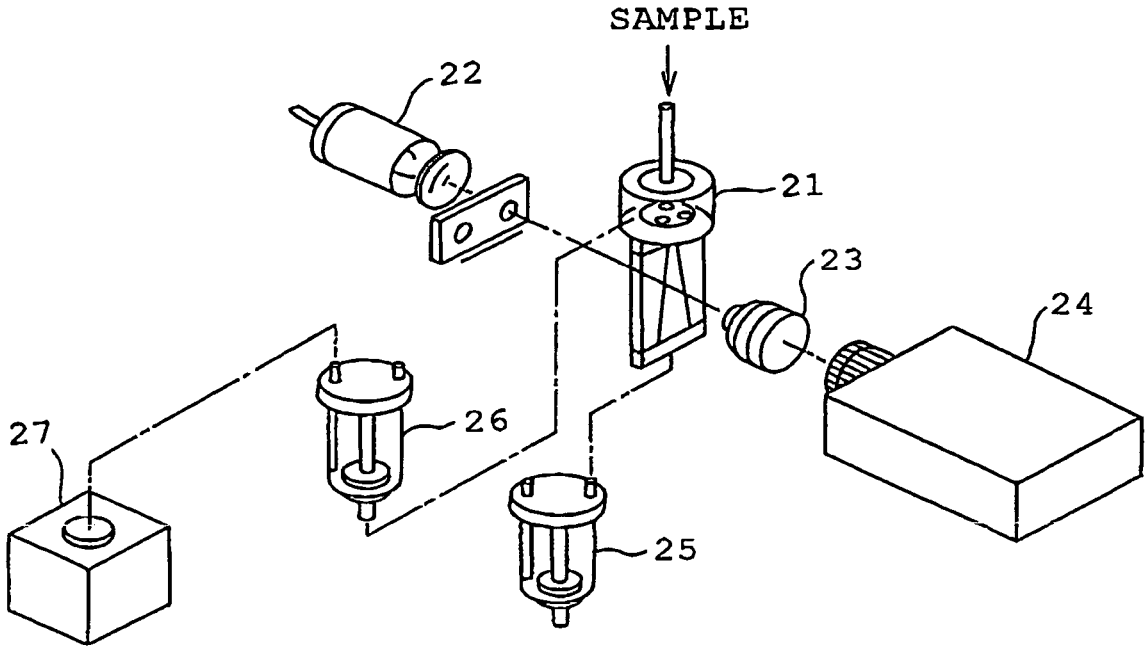
FIG. 1 is a diagram that illustrates the configuration of a particle size analyzer used for the cumulative measurement of the number of toner particles having particle diameters of 0.6 μm or more to 4 μm or less in toner.

The one-component magnetic toner for developing an electrostatic charge image of the present invention (hereinafter, simply referred to as a "one-component magnetic toner") contains: toner particles containing at least fine magnetic particles (A) and a binder resin; and fine magnetic particles (B) externally added to the magnetic toner particles, and the maximum permeability ($\mu m_A$) of the fine magnetic particles (A) contained in the toner particles and the maximum permeability ($\mu m_B$) of the fine magnetic particles (B) externally added to the toner particles satisfy a relationship represented by the following formula (1):

$$\mu m_B/\mu m_A \leqq 1.8 \quad (1)$$

In the present invention, the fine magnetic particles (A) contained in (i.e., internally added to) the toner particles and the fine magnetic particles (B) externally added to the toner particles (that is, mixed with the toner particles) may be well-known magnetic materials including: metals such as iron, cobalt, and nickel, and alloys thereof; metal oxides such as $FeSO_4$, $\gamma$-$Fe_2O_3$, and cobalt-doped iron oxide; ferrites such as a Mn—Zn ferrite and a Ni—Zn ferrite; powders mainly composed of magnetite and hematite; and materials obtained by treating the surfaces of these materials with a surface treatment agent such as a silane coupling agent or a titanate coupling agent, or with a polymer coating.

The maximum permeability ($\mu m_A$) of the fine magnetic particles (A) internally added to the toner particles is preferably 2.0 to 20.0 μH/m, more preferably 3.5 to 6.0 μH/m in terms of the easiness of bearing and developing toner. In addition, the magnetization of the fine magnetic particles (A) at a magnetic field intensity of 79.6 kA/m is preferably in the range of 25 to 100 $Am^2/kg$.

The number average particle diameter of the fine magnetic particles (A) internally added to the toner particles is preferably in the range of approximately 0.05 to 1 μm in terms of dispersability thereof to the binder resin. In addition, the proportion of the fine magnetic particles (A) in a mixture with the binder resin is in the range of preferably 40 to 200 parts by mass, more preferably 45 to 150 parts by mass, particularly preferably 50 to 120 parts by mass, with respect to 100 parts by mass of the binder resin.

Considering the ease of recycling after the use of a toner cartridge, the maximum permeability ($\mu m_B$) of the fine magnetic particles (B) externally added to the toner particles is preferably 2.0 to 6.5 μH/m, more preferably 2.5 to 6.0 μH/m, particularly preferably 2.5 to 5.4 μH/m. In addition, the magnetization of the fine magnetic particles (B) at a magnetic field intensity of 79.6 kA/m is preferably in the range of 20 to 80 $Am^2/kg$.

Furthermore, the number average particle diameter of the fine magnetic particles (B) externally added to the toner particles is preferably in the range of approximately 0.05 to 3 μm and the proportion of the fine magnetic particles (B) in a mixture with the toner particles is preferably in the range of 0.1 to 2.0% by mass with respect to the mass of the toner particles.

The number average particle diameter of the fine magnetic particles (A) internally added to the toner particles and the number average particle diameter of the fine magnetic particles (B) externally added to the toner particles can be determined by subjecting an enlarged photograph taken by transmission electron microscopy or the like to a digitizer or the like.

The relationship among the magnetic flux density, the magnetic field, and the magnetic permeability μ can be represented by the following equation:

$$B=\mu \cdot H$$

In the above equation, B is the magnetic flux density and H is the magnetic field. The above equation shows that a substance shows higher magnetization against a certain magnetic field as the substance has higher permeability. When the magnetic field is caused by a magnet, the substance will be strongly attracted by the magnet.

In the present invention, value of the maximum permeability can be measured using any of various measuring methods.

For instance, a method of directly measuring such a value of the magnetic substance in a powdery form is as follows. By employing a vibrating sample magnetometer (VSM-3, manufactured by Toei Industry Co., Ltd., Tokyo, JAPAN), a predetermined amount of powder of the magnetic substance is placed in a holder and a B—H curve is obtained in a maximum applied magnetic field of 796 (kA/m) to determine the maximum permeability. Alternatively, another method may be used, in which a uniform winding is given to a toroid-like magnetic core and then an appropriate alternating-magnetic field is applied, followed by obtaining the value of the maximum permeability from a change in inductance at that time.

Furthermore, the fine magnetic particles (A) and (B) used in the present invention are preferably subjected to a hydrophobic treatment as described above. The hydrophobic treatment allows the toner itself to have improved humidity characteristics while a small change in developing characteristics under environmental variation.

Regarding the hydrophobic treatment, the fine magnetic particles are subjected to a hydrophobic treatment using, for example, 0.01 to 5 parts by mass of a titanium coupling agent, a silane coupling agent, or the like with respect to 100 parts by mass of the fine magnetic particles. Specific examples of treatment agents include: titanium coupling agents such as tetrabutyl titanate, tetraoctyl titanate, isopropyl triisostearoyl titanate, isopropyl tridecylbenzenesulfonyl titanate, and bis (dioctyl pyrophosphate) oxyacetate titanate; and silane coupling agents such as γ-(2-aminoethyl) aminopropyltrimethoxysilane, γ-(2-aminoethyl) aminopropylmethyldimethoxysilane, γ-methacryloxypropyltrimethoxysilane, N-β-vinylbenzylaminoethyl-N-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. The hydrophobic treatment generally involves: dissolving a coupling agent in a solvent such as toluene and benzene, in which the coupling agent are soluble; adding and mixing the coupling agent solution dropwise at a rate allowing sufficient dispersion to dried magnetic powder stirred with various mills for a reaction; and evaporating the solvent and reaction by-products for removal thereof.

For allowing the fine magnetic particles (B) attached on (i.e., externally added to) the toner particles, in the magnetic field such as on the developer bearing member, to be stably present on the surface of toner particles, the ratio ($\mu m_B/\mu m_A$) of the maximum permeability ($\mu m_B$) of the fine magnetic particles (B) externally added to the toner particles and the maximum permeability ($\mu m_A$) of the fine magnetic particles (A) internally added to the toner particles should be 1.8 or less. In addition, the ratio ($\mu m_B/\mu m_A$) is preferably 1.4 or less, particularly preferably 0.9 or less.

As a method of adjusting the ratio ($\mu m_B/\mu m_A$) within the above range, for example, kinds and amounts of the fine magnetic particles (A) and (B) contained in and externally added to the toner particles may be suitably defined, respectively. In addition, as a method of making the maximum permeability ($\mu m_A$) of the fine magnetic particles (A) internally added to the toner particles and the maximum permeability ($\mu m_B$) of the fine magnetic particles (B) externally added to the toner particles into their predetermined levels, for example, a suitable magnetic material may be selected or subjected to a well-known treatment such as a heat treatment or a treatment in a revolving magnetic field.

Examples of the binder resin included in the toner particles constituting the one-component magnetic toner of the present invention include: styrene-based resins such as homopolymers of styrene-substituted derivatives (polystyrene, poly-p-chlorostyrene, and polyvinyl toluene, for example) and styrene copolymers; polyvinyl chloride; phenol resins; natural modified phenol resins; natural modified maleic resins; acrylic resins; methacrylic resins; polyvinyl acetate; silicone resins; polyester resins; polyurethane; polyamide resins; furan resins; epoxy resins; xylene resins; polyvinyl butyral; terpene resins; cumarone-indene resins; and petroleum-based resins. Of those, crosslinked styrene-based resins or polyester resins are preferable binder resins.

Examples of the styrene copolymers include a styrene-p-chlorostyrene copolymer, a styrene-vinyl toluene copolymer, a styrene-vinyl naphthalene copolymer, a styrene-acrylate copolymer, a styrene-methacrylate copolymer, a styrene-α-methyl chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, and a styrene-acrylonitrile-indene copolymer.

Examples of a comonomer to a styrene monomer of the styrene copolymer include: monocarboxylic acids each having a double bond and substituted derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids each having a double bond and substituted derivatives thereof such as maleic acid, butyl maleate, methyl maleate, and dimethyl maleate; vinyl chloride; vinyl esters such as vinyl acetate and vinyl benzoate; ethylene-based olefins such as ethylene, propylene, and butylene; vinyl ketones such as vinyl methyl ketone and vinyl hexyl ketone: and vinyl ethers such as vinyl methyl ether, vinyl ethyl ether, and vinyl isobutyl ether. The vinyl monomer may be used alone, or in combination of two or more types of vinyl monomers, with the styrene monomer.

A compound having two or more double bonds capable of polymerization can be mainly used as a crosslinking agent which can be used for obtaining the styrene copolymer. Examples thereof include: aromatic divinyl compounds such as divinylbenzene and divinylnaphthalene; carboxylates having two double bonds such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds having three or more vinyl groups. The crosslinking agent may be used alone, or in combination of two or more types of crosslinking agents.

The polyester resin may be obtained through condensation polymerization of alcohol and carboxylic acid. Examples of the alcohol include: diols such as polyethylene glycol, diethylene glycol, triethylene glycol, 1,2-propylene glycol, 1,3-propylene glycol, 1,4-butanediol, neopentyl glycol, and 1,4-butenediol; 1,4-bis (hydroxymethyl) cyclohexane, bisphenol A, hydrogenated bisphenol A, and etherified bisphenols such as polyoxyethylene bisphenol A and polyoxypropylene bisphenol A; dihydric alcohol monomers prepared by substituting the above-mentioned alcohol with a saturated or unsaturated hydrocarbon group having 3 to 22 carbon atoms; and other dihydric alcohol monomers.

Further, examples of the carboxylic acid used for obtaining the polyester resin include: maleic acid, fumaric acid, mesaconic acid, citraconic acid, itaconic acid, gultaconic acid, phthalic acid, isophthalic acid, terephthalic acid, cyclohexane dicarboxylic acid, succinic acid, adipic acid, sebacic acid, and malonic acid; divalent organic acid monomers each prepared by substituting each of the above-mentioned carboxylic acids with a saturated or unsaturated hydrocarbon group having 3 to 22 carbon atoms; acid anhydrides thereof; dimers of a lower alkyl ester and linolenic acid; and other divalent organic acid monomers.

The polyester resin as a binder resin may be obtained using not only polymers of the above-mentioned bifunctional monomers, but also preferably polymers containing components of trifunctional or more, that is, polyfunctional monomers. Examples of polyalcohol monomers of trihydric or more as the polyfunctional monomers include: sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Further, examples of the polyvalent carboxylic acid monomers of trivalent or more include: 1,2,4-benzenetricarboxylic acid; 1,2,5-benzenetricarboxylic acid; 1,2,4-cyclohexanetricarboxylic acid; 2,5,7-naphthalenetricaroboxylic acid; 1,2,4-naphthalenetricarboxylic acid; 1,2,4-butanetricarboxylic acid; 1,2,5-hexanetricarboxylic acid; 1,3-dicarboxyl-2-methyl-2-methylenecarboxypropane; tetra (methylenecarboxyl) methane; 1,2,7,8-octanetetracarboxylic acid; empol trimer acid; and acid anhydrides thereof.

In the one-component magnetic toner of the present invention, it is preferable to use a charge-controlling agent such that the charge-controlling agent is blended in (internally added to) the toner particles or mixed with (externally added to) the toner particles. The charge-controlling agent enables the amount of charge of the toner to be suitably controlled according to a developing system. Materials that control the charge of the one-component magnetic toner to negative charge include those described below.

Organic metal complexes or chelate compounds are effective for controlling the charge, and examples of the charge-controlling agent include monoazo metal complexes, acetylacetone metal complexes, metal complexes of aromatic hydroxycarboxylic acid, and metal complexes of aromatic dicarboxylic acid. Other examples thereof include: aromatic hydroxycarboxylic acid, aromatic monocarboxylic acid, and aromatic polycarboxylic acid; metal salts or esters of the carboxylic acid selected from the above; aromatic polycarboxylic acid anhydrides; and phenol derivatives such as bisphenol.

Examples of the charge-controlling agent that controls the charge of the one-component magnetic toner of the present invention to positive charge include: nigrosine and modified products thereof with aliphatic metal salts; quaternary ammonium salts such as tributylbenzylammonium-1-hydroxy-4-naphthosulfonate and tetrabutylammonium tetrafluoroborate; onium salts such as phosphonium salts which are analogues of the quaternary ammonium salts and lake pigments of the onium salts; triphenylmethane dyes and lake pigments thereof (examples of a lake agent used include phosphotungstic acid, phosphomolybdic acid, phosphotungstic molybdic acid, tannic acid, lauric acid, gallic acid, ferricyanic acid, and ferrocyanic acid); metal salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate. Each of the charge-controlling agents may be used alone, or two or more types of charge-controlling agents may be used in combination.

It is preferable to use the above charge-controlling agent in fine particles. In this case, the number average particle diameter of the charge-controlling agent fine particles is preferably 2 μm or less, more preferably 1 μm or less. When the charge-controlling agent fine particles are internally added to the toner particles, the content of the charge-controlling agent is preferably 0.1 to 20 parts by mass, more preferably 0.2 to 10 parts by mass with respect to 100 parts by mass of the binder resin.

The one-component magnetic toner of the present invention preferably contains a wax blended in (internally added to) the toner particles. Examples of the wax include: petroleum-based waxes such as a paraffin wax, a microcrystalline wax, and petrolatum, and derivatives thereof; montan waxes and derivatives thereof; Fischer-Tropsch waxes and derivatives thereof; polyolefin waxes such as a polyethylene and derivatives thereof; and natural waxes such as a carnauba wax and a candelilla wax and derivatives thereof. The derivatives include oxides, block copolymers with vinyl-based monomers, and graft modified products. Further examples of the wax include: higher aliphatic alcohols; fatty acids such as stearic acid and palmitic acid and compounds thereof; acid amide waxes, ester waxes, ketone, hydrogenated castor oil, and derivatives thereof; vegetable waxes; and animal waxes. The use of such a wax improves anti-offset properties of the toner.

For using a wax in the one-component magnetic toner of the present invention, it is preferable that the one-component magnetic toner has a wax content of 0.5 to 50 parts by mass with respect to 100 parts by mass of the binder resin.

Further, the one-component magnetic toner of the present invention may be mixed with other additives as required. Examples of the additives include: lubricants such as a fluorine resin and zinc stearate; abrasives such as cerium oxide and silicon carbide; caking inhibitors; conductivity imparting agents such as carbon black and tin oxide; and fixing auxiliaries such as low molecular weight polyolefin. One or two or more of any known inorganic fine particles such as silicon oxide, aluminum oxide, titanium oxide, barium titanate, and hydrophobically treated products thereof can be used as inorganic fine particles used as fluidity imparting agents for the one-component magnetic toner of the present invention. Further, examples of surface treatment agents for the inorganic fine particles that can be used in the present invention include: various silicone oils such as methylhydrogenpolysiloxane, dimethylpolysiloxane, and methylphenylpolysiloxane; various alkylsilanes such as methyltrimethoxysilane, ethyltrimethoxysilane, hexyltrimethoxysilane, octyltrimethoxysilane, decyltrimethoxysilane, octadecyltrimethoxysilane, dimethyldimethoxysilane, octyltriethoxysilane, and n-octadecyldimethyl (3-(trimethoxysilyl) propyl) ammonium chloride; various fluoroalkylsilanes such as trifluoromethylethyltrimethoxysilane and heptadecafluorodecyltrimethoxysilane; and various metal-based coupling agents such as silane-based, titanium-based, aluminum-based, and alumina-zirconia-based coupling agents particularly represented by silane coupling agents such as vinyltrimethoxysilane and γ-aminopropyltrimethoxysilane. Two or more types of the treatments are preferably used in combination.

Preferable as a method of manufacturing toner particles in the present invention is a method including: sufficiently mixing the toner constituent materials described above by means of a blending machine such as a ball mill; kneading the mixture by means of a thermal kneading machine such as a thermal roll kneader or an extruder; cooling and solidifying the kneaded product; mechanically pulverizing the solidified product; and classifying the pulverized powders to obtain toner particles. Alternate methods include: a method involving preparing an emulsified suspension by mixing monomers to constitute a binder resin with predetermined materials, and polymerizing the suspension to obtain toner particles; a method involving agglutinating resin fine particles and predetermined materials in a dispersion medium to obtain toner; a method involving including predetermined materials in a core material or a shell material or both of them in the so-called microcapsule toner consisting of the core material and the shell material; and a method involving dispersing constituent materials in a binder resin solution and then spray drying the dispersant to obtain toner particles. Furthermore, the one-component magnetic toner can be manufactured by sufficiently mixing the fine magnetic particles (B) in the present invention and optionally a desired additive and toner particles with a blending machine such as a HENSCHEL MIXER.

The weight average particle diameter of toner particles in the present invention is preferably 3.0 to 12.0 μm, more preferably 5.0 to 9.0 μm.

In the toner of the present invention, in terms of attaining a small-sized and lightweight device, and providing high image quality and the ease of recycling a toner cartridge, the cumulative ratio of particles having particle diameter of 0.6 μm or more to 4 μm or less in the toner is preferably 10 to 50%, more preferably 10 to 40%, particularly preferably 10 to 30% by number in measurement where particles having particle diameter of 0.6 μm or more to 4 μm or less are considered.

The cumulative ratio of toner particles having particle diameter of 0.6 μm or more to 4 μm or less in the toner is determined employing a flow-type particle size analyzer FPIA-1000 (manufactured by Toa Medical Electronics Co., Ltd.).

Figure 2:
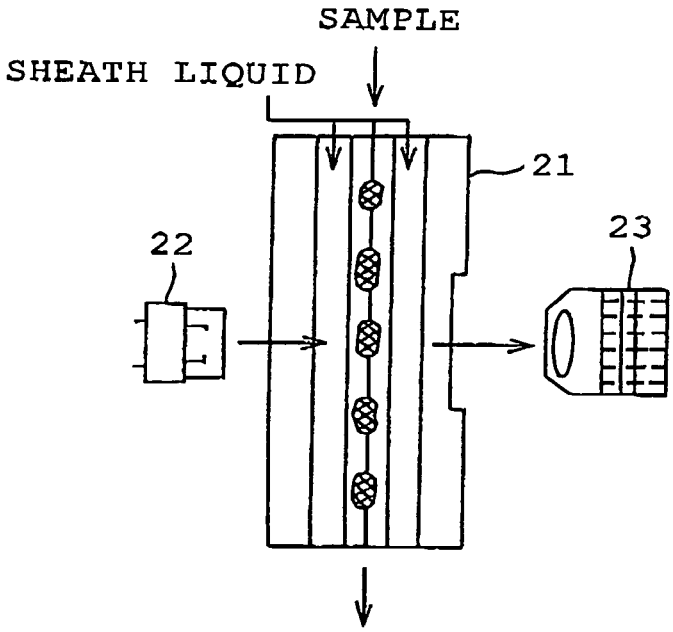
FIG. 2 is a diagram that illustrates a main part of the particle size analyzer shown in FIG. 1.

Hereinafter, the flow-type particle size analyzer will be described with reference to the attached drawings. FIG. 1 schematically illustrates the analyzing device used in the present invention. FIG. 2 is a diagram illustrating a main part of the analyzing device. As shown in FIG. 1, the device includes: a source 27 for supplying a sheath liquid to be used for the measurement; a sheath-liquid chamber 26 for temporarily storing the sheath liquid and sending out a predetermined amount thereof; a flat sheath low cell 21 for receiving a sample from a supplying source (not shown) to form a sample flow together with the sheath liquid introduced from the sheath-liquid chamber 26; a waste-fluid chamber 25 provided under the flat sheath low cell 21; a stroboscope 22 for emitting light for every definite period of time and an objective lens 23, which are arranged on the opposite sides of the central part of the flat sheath low cell 21; and a CCD camera 24 provided behind the objective lens 23.

At the time of the measurement, a sample suspension in which toner particles are dispersed and suspended in an aqueous solution of surfactant is used and a predetermined amount of the suspension is then sucked in a suction pipette (not shown). The sample suspension sucked is introduced into the flat sheath low cell 21 through a sampling filter (not shown). As shown in FIG. 2, the sheath liquid is introduced into the flat sheath low cell 21 from the chamber and then a flat sample flow is formed by the sheath liquid. The sample suspension passes through the central part of the flat sheath low cell 21 such that the sample suspension passes between the different flows of sheath liquid.

As shown in FIG. 1, the light emitted from the stroboscope 22 at regular time intervals irradiates the sample suspension passing through the flat sheath low cell 21. Every time the light irradiates, the CCD camera 24 takes a static image of the toner particles in the sample suspension through the objective lens 23. The particle image taken by the CCD camera 24 is subjected to an image analysis. From the results of the image analysis, the circle-equivalent diameter and the degree of circularity are calculated from the projected area and circumferential length of the particle image, and thus the particle diameter distribution, circularity distribution, and so on can be determined.

Furthermore, the one-component magnetic toner for developing an electrostatic charge image of the present invention is used in a process cartridge which integrally includes a developing device and at least one selected from the group of an image bearing member, a cleaning member, and a charging member, and which is removably attached to an electrophotographic apparatus. In particular, the toner can be suitably used in a process cartridge equipped with a developing device including: a storage part for storing a developer; a developer bearing member having a non-magnetic sleeve with a magnet fixed therein to bear the developer on the non-magnetic sleeve; and a regulating member provided so as to be in contact with the developer bearing member to regulate the amount of the developer born on the developer bearing member.

Employing the one-component magnetic toner of the present invention in the process cartridge constructed as described above, fine magnetic particles (B) provided as an external additive is hardly released from the surface of toner particles. In addition to the effects of lowering the amount of the fine magnetic particles (B) attached on the developer bearing member and preventing the generation of white lines or fogging in an image, the component that constitute the process cartridge can be easily reproduced after the use of the process cartridge. Therefore, the employment becomes a preferable embodiment that realizes the effect of significantly increasing the number of recyclings.

A photosensitive member having an amorphous silicon photosensitive layer or an organic photosensitive layer is preferably used as an image bearing member used in the process cartridge of the present invention. In particular, a photoconductor having an organic photosensitive layer is preferable. The organic photosensitive layer may be of a single layer type, where the photosensitive layer contains a charge-generating substance and a substance having a charge-transporting ability in the same layer or may be of a function-separating type containing a charge-transporting layer and a charge-generating layer. One of the preferable examples is a laminated type photosensitive layer constructed of a charge-generating layer and a charge-transporting layer which are laminated on a conductive substrate in that order.

The cleaning member may be a blade, a fur brush, or the like. In particular, it is preferable that the cleaning member be one using urethane or silicone rubber molded in blade form in terms of cleaning property.

As a charging member, there are a non-contact charging member such as one using a corona-charging device and a contact charging member such as one using a conductive roller, a conductive brush, a conductive sheet, or the like. Any of them can be used. It is noted that the contact charging member does not require high voltage, and has a construction preferable to attain efficient uniform charging, simplification, lower ozone generation, and so on. Of those, a contact charging member using a charging roller is preferably used.

Preferable process conditions at the time of employing a charging roller as a charging member include: an abutting pressure of 4.9 to 490 N/m (5 to 500 g/cm) of the charging roller against the image bearing member; and an AC voltage of 0.5 to 5 kVpp, an AC frequency of 50 Hz to 5 kHz, and a DC voltage of ±0.2 to ±1.5 kV when the AC voltage is superimposed on the DC current, or include a direct current of ±0.2 to ±5 kV when a DC voltage is used.

The developing device includes: a storage part for storing a developer; a developer bearing member including a non-magnetic sleeve having a magnet fixed therein; and a regulating member provided so as to be in contact with the developer bearing member to regulate the amount of a developer born on the non-magnetic sleeve.

The amount of the developer born on the developing sleeve can be regulated by the regulating member provided so as to be in contact with the developing sleeve at the time of rotation. The regulator allows the developer to be born as a layer having a certain thickness on the developing sleeve. It is preferable that an abutting pressure of the regulating member for regulating the thickness of the layer of the developer against the developer bearing member (developing sleeve) be a line pressure of 5 to 50 g/cm because the regulation of the developer can be stabilized and the magnetic toner layer can have an appropriate thickness. If the abutting pressure of the regulating member for regulating the thickness of the developer layer is less than a linear pressure of 5 g/cm, the force of regulating the developer layer weakens to cause fogging and the leakage of the developer from the developing sleeve. If the abutting pressure exceeds a line pressure of 50 g/cm, the developer receives a larger damage from the regulating member and tends to cause the degradation of the developer and the fusion of the developer to the developer bearing member and to the regulating member that regulates the thickness of the developer layer.

The materials of the regulating member for regulating the thickness of the developer layer include elastic plates made of rubber-elastic materials such as urethane rubber and silicone rubber and metal-elastic materials such as phosphor bronze and stainless steel. Of those, in particular, the urethane rubber or silicone rubber is preferably used because it makes the thickness of the developer layer uniform, weakens the load on the developer, and shows advantageous effects against the scraping the developer bearing member.

The non-magnetic sleeve for bearing the developer, which can be used in the developer bearing member, is preferably one prepared by roughening up the outer surface of a metallic cylinder made of aluminum, stainless steel, or the like by means of a sandblast or the like, or one having a surface layer formed by a resin in which a conductive particle such as carbon black or graphite is dispersed in the outer surface of the cylinder. The resins to be used for the formation of the surface layer include a phenol resin, a styrene resin, and a polyamide resin. Of those, the phenol resin is particularly preferable.

In the process cartridge, each constituent member such as an image bearing member, a charging member, a developing device, or a cleaning member may be provided with a means for accumulating the information about the usage-history of each constituent member or of the process cartridge itself or with a means for displaying such information. In addition, the process cartridge itself may be also provided with a means for accumulating the information about the usage-history of the process cartridge or each member constituting the process cartridge or a means for displaying such information. In these cases, at the time of recycling the process cartridge, the replacement or cleaning of the member, which is previously defined, is performed according to the above accumulated or displayed usage-history information. Therefore, the inspection of each member or the like at the time of recycling can be diminished or omitted.

The accumulation or display methods for the usage-history information include: sticking a seal, on which the number of uses is expressed in figures; providing a marker having a color corresponding to the number of uses; directly writing the number of uses by means of marking or the like; mounting a memory on the process cartridge and writing the information corresponding to the number of uses in the memory; providing the process cartridge with a means of identification and accumulating the information about the history of each member so as to correspond to the identification information.

When the one-component toner for developing an electrostatic charge image is used up or the process cartridge cannot exhibit its desired performance, the process cartridge is removed from an electrophotographic apparatus. The process cartridge removed is subjected to recycling such as: cleaning or replacement of members that constitute the process cartridge according to the usage-history information; or supply of the one-component toner to the developing device. When the recycling is carried out, the usage-history information is updated by a predetermined method. Then, the updated usage-history information will be used for the subsequent recycling of a process cartridge.

EXAMPLES

Hereinafter, the present invention will be described more concretely with reference to examples but the present invention is not limited to these examples. In addition, the term "part" in the examples represents "part by mass".

Example 1

100 parts of a styrene-butyl acrylate copolymer (the mole ratio between styrene and butyl acrylate=80/20, Mn=7,200, Mw=280,000) as a resin binder, 90 parts of magnetic ferric oxide ($Fe_2O_3$; average particle diameter=0.25 μm, and maximum permeability=2.0 μH/m), 3 parts of monoazo iron complex (T-77, available from Hodogaya Chemical Co., Ltd.) as a negative charge-controlling agent, 2 parts by Fischer-Tropsch wax (melting point=107° C., Mn=550, and Mw=910), and 2 parts of alcohol wax (Unirin 700, available from Toyo Petrolite Co., Ltd.) were uniformly mixed together in advance. Then, the mixture was molten and kneaded by means of a biaxial extruder heated at 130° C. The kneaded product thus obtained was cooled down and then roughly pulverized with a hammer mill. Then, the roughly pulverized product was finely pulverized with a jet mill, followed by classifying the finely pulverized product by a pneumatic classifier to obtain black toner particles (weight average particle diameter=6.8 μm). Then, 0.5 part of magnetic ferric oxide (average particle diameter=0.30 μm and maximum permeability=3.6 μH/m) treated with silicone oil and 1.2 parts of silica fine particles having hydrophobic property (subjected to a hydrophobic treatment with hexamethyldisilazane, BET specific surface area=200 $m^2/g$) were added to 100 parts of the resulting black toner particles and the whole was then mixed together while being stirred for 2 minutes by means of a HENSCHEL MIXER at 1,500 rpm, followed by removing rough particles through a 150-mesh screen (opening=100 μm) to obtain a one-component magnetic toner 1. The cumulative ratio of toner particles having particle diameters of 0.6 μm or more to 4 μm or less in the toner 1 was 19% by number.

Examples 2 to 25

One-component magnetic toners 2 to 25 were prepared using the same method as that of Example 1 described above, except that the fine magnetic particles (A) internally added to the toner particles and the fine magnetic particles (B) externally added to the toner particles were replaced with magnetic ferric oxide represented in Table 1. Furthermore, the intensity of magnetization of the magnetic fine particles A used in Example 13 was 69 $Am^2/kg$ under the magnetic field of 79.6 kA/m and that of the magnetic fine particles B was 35 $Am^2/kg$ under the magnetic field of 79.6 kA/m.

Comparative Examples 1 and 2

One-component magnetic toners 26 and 27 were prepared using the same method as that of Example 1 described above, except that the fine magnetic particles (A) internally added to the toner particles and the fine magnetic particles (B) externally added to the toner particles were replaced with magnetic ferric oxide represented in Table 1.

Table 1 represents the maximum permeabilities of the internally-added and externally-added fine magnetic particles (A) and (B) used for each toner and also the ratio ($\mu m_B/\mu m_A$) between them.

TABLE 1

| | Maximum permeability ($\mu m_A$) of fine magnetic particles (A) | Maximum permeability ($\mu m_B$) of fine magnetic particles (B) | Ratio of maximum permeabilities ($\mu m_B/\mu m_A$) | Cumulative ratio of toner having particle diameters of 0.6-4 μm (% by number) |
|---|---|---|---|---|
| Example 1 | 2.0 | 3.6 | 1.8 | 19 |
| Example 2 | 2.5 | 4.3 | 1.7 | 20 |
| Example 3 | 3.0 | 4.8 | 1.6 | 13 |
| Example 4 | 3.5 | 5.3 | 1.5 | 16 |
| Example 5 | 4.0 | 5.6 | 1.4 | 15 |
| Example 6 | 4.5 | 5.9 | 1.3 | 11 |
| Example 7 | 5.0 | 6.0 | 1.2 | 14 |
| Example 8 | 5.5 | 6.1 | 1.1 | 18 |
| Example 9 | 6.0 | 6.0 | 1.0 | 14 |
| Example 10 | 6.5 | 5.9 | 0.9 | 16 |
| Example 11 | 4.5 | 3.6 | 0.8 | 18 |
| Example 12 | 4.5 | 3.2 | 0.7 | 20 |
| Example 13 | 4.5 | 2.7 | 0.6 | 16 |
| Example 14 | 7.0 | 3.5 | 0.5 | 13 |
| Example 15 | 10.0 | 4.0 | 0.4 | 17 |
| Example 16 | 12.0 | 3.6 | 0.3 | 11 |
| Example 17 | 10.0 | 2.0 | 0.2 | 17 |
| Example 18 | 6.0 | 6.0 | 1.0 | 55 |
| Example 19 | 6.0 | 6.0 | 1.0 | 45 |
| Example 20 | 6.0 | 6.0 | 1.0 | 33 |
| Example 21 | 6.0 | 6.0 | 1.0 | 26 |
| Example 22 | 6.5 | 5.9 | 0.9 | 58 |
| Example 23 | 6.5 | 5.9 | 0.9 | 47 |
| Example 24 | 6.5 | 5.9 | 0.9 | 36 |
| Example 25 | 6.5 | 5.9 | 0.9 | 24 |
| Comparative Example 1 | 4.5 | 9.0 | 2.0 | 15 |
| Comparative Example 2 | 4.5 | 9.9 | 2.2 | 14 |

<Evaluation>

Figure 3:
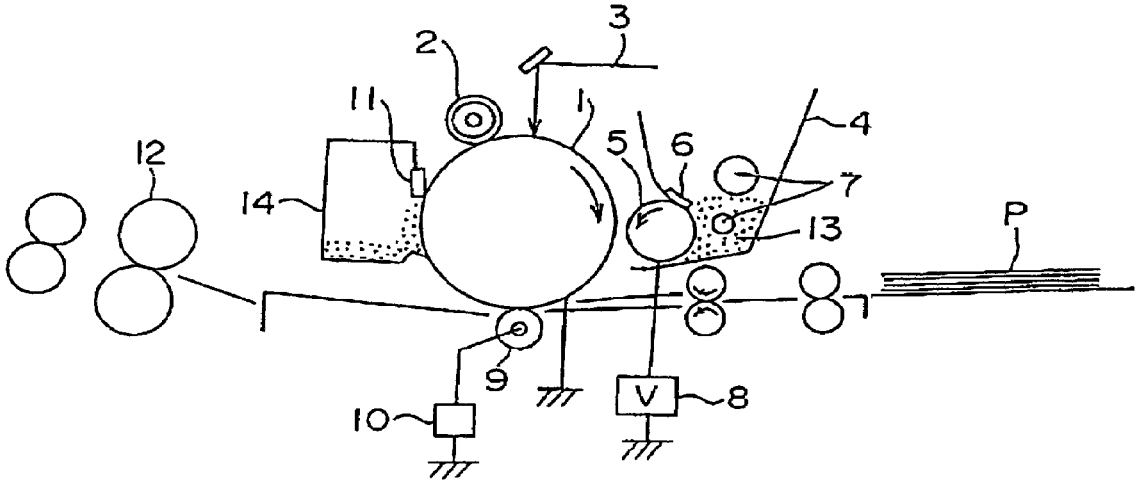
FIG. 3 is a diagram that schematically illustrates the configuration of an example of an image-forming apparatus which is capable of suitably using the one-component magnetic toner of the present invention.

Using an image-forming apparatus shown in FIG. 3 equipped with a process cartridge 16 shown in FIG. 14, each of the one-component magnetic toners 1 to 27 prepared in Examples 1 to 25 and Comparative Examples 1 and 2 was placed in the process cartridge. Subsequently, the evaluation was performed according to an image-evaluating method described below. Tables 2 to 5 list the results of the evaluation.

The process cartridge and the image-forming apparatus employed in this example include a primary charging device 2, an exposure optical system 3, a developing device 4, a transfer device 9, and a cleaning member 11 arranged around a photosensitive member 1 provided as an image bearing member in that order. Here, the primary charging device is one using a contact-charging roller abutting with the surface of the photosensitive member. Then, the photosensitive member is primary-charged by the application of charging voltages: a DC voltage of −625 V and an AC voltage of 1.8 kVpp at a frequency of 370 Hz.

The exposure optical system 3 forms an electrostatic latent image by irradiating the primary-charged photoconductor 1 with a laser beam. In this case, the laser beam is under ON-OFF controls depending on an image to be formed.

The developing device 4 includes: a developer bearing member 5 in the form a roller facing to the surface of the photosensitive member 1 and having a rotary axis parallel to the rotary axis of the photosensitive member 1; a toner container 15 (as a storage part) for storing a one-component magnetic toner 13, which has an opening near the developer bearing member 5; a toner-stirring means 7 (not shown in FIG. 4) installed in the toner container 15 to stir the one-component magnetic toner and feed the toner to the developer bearing member 5; a regulating member 6 for regulating the thickness of the toner layer, which is for regulating the amount of the toner transferred by the toner-stirring means 7 and born on the surface of the developer bearing member 5 to make the thickness of the toner uniform; and a development bias power source 8 for applying a development bias on the developer bearing member 5. The developer bearing member 5 has an outer diameter of 10 mm and an angular speed of 21.0 rad/sec at the time of development. The electrostatic latent image formed on the photosensitive member 1 by the exposure optical system 3 is developed with the one-component magnetic toner by the developing device 4, allowing the image to be visualized as a toner image.

The toner image on the photosensitive member 1 is transferred, by a transfer device 9 to which a transfer current generating device 10 applies a transfer bias, to a transferring material P such as a sheet of paper fed to an abutting portion (nip) between the photoconductor 1 and the transfer device 9. Then, the image is fixed on the transferring material P by a fixing device 12, resulting in a fixed image. On the other hand, directly after the transfer of the toner image on the transfer material P, the toner remaining on the surface of the photosensitive member 1 (transfer-remaining toner) is removed by the cleaning member 11 and then the removed transfer-remaining toner is accumulated in a waste toner container 14.

Figure 4:
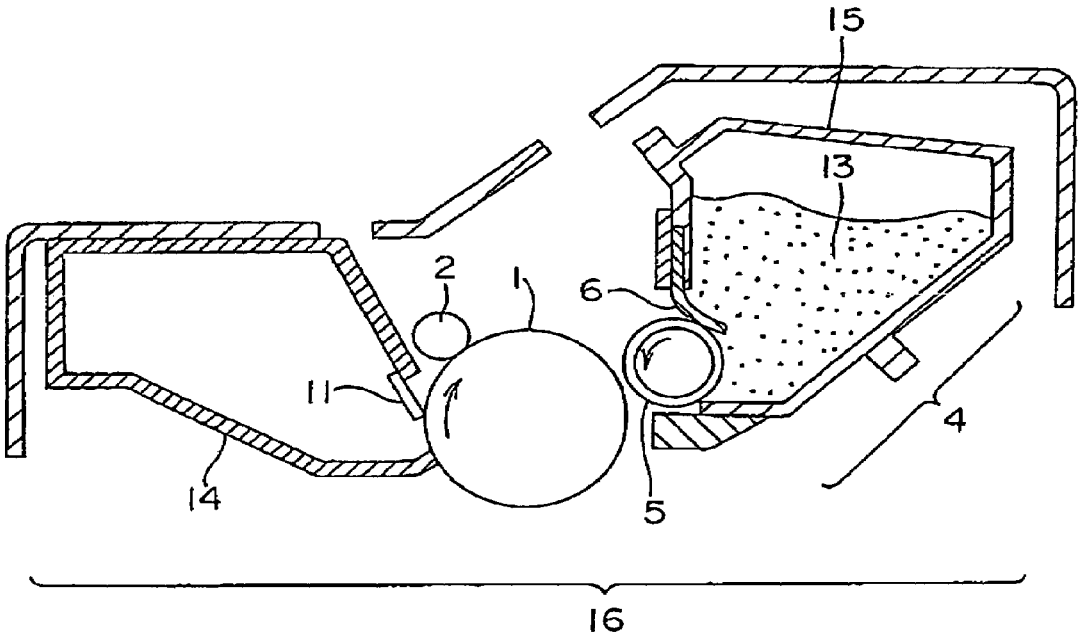
FIG. 4 is a diagram that illustrates the configuration of an example of a process cartridge which is capable of suitably using the one-component magnetic toner of the present invention.

Furthermore, as shown in FIG. 4, the image-forming apparatus is constructed such that a process cartridge 16 is removably attached to the body of the image-forming apparatus. The process cartridge 16 integrally holds the photosensitive member 1, the primary charging device 2, the developing device 4, the cleaning member 11, and the waste toner container 14.

Hereinafter, the evaluation conducted on each of the above magnetic toners will be described.

(1) Durability Evaluation i) Image's White Line

An image having an image area ratio of approximately 3% was printed out on 5,000 sheets under high-temperature and high-humidity environments (33.0° C., 95% RH (relative humidity)). On the way, halftone images (1 dot and 2 spaces in the sub-scanning direction) were printed out at an initial print-out (at the 10th sheet) and at 1,000-sheet intervals, respectively. According to the following evaluation criteria, the resulting image was evaluated for degree of generation of white lines at each of the predetermined number of durable sheets. Table 2 shows the evaluation results.

[Evaluation Criteria on Image's White Line]

A; No white line occurs.

C: White lines occur, which are not clearly observed with the naked eye.

E: The occurrence of many white lines can be observed with the naked eye.

B is an intermediate level between A and C, and also D is an intermediate level between C and E.

ii) Image Fogging

Using an image for evaluating image's white lines, the evaluation on fogging was conducted according to the following evaluation criteria. Table 3 shows the results of the evaluation.

[Evaluation Criteria on Fogging]

A: No fogging occurs.

C: Fogging can be observed easily.

E: Fogging can be observed on the whole surface.

B is an intermediate level between A and C, and also D is an intermediate level between C and E.

(2) Evaluation on the Easiness of Recycling

After the completion of the evaluation on durability in the item (1), the process cartridge was disassembled. Then, the developer bearing member contaminated with the attached toner was removed. Then, air was sprayed on the developer bearing member with an air gun for 30 seconds to remove the attached toner from the developer bearing member. Subsequently, the removal of toner was checked with eyes, followed by reassembling a process cartridge using the recovered developer bearing member and new other components.

The process cartridge was remounted on the image-forming apparatus and then subjected to the durability evaluation as described above and also subjected to the evaluations on image's white lines and image fogging as described above. Tables 4 and 5 show the results of those evaluations.

TABLE 2

Results of evaluation on image's white lines

| | Initial | 1,000th sheet | 2,000th sheet | 3,000th sheet | 4,000th sheet | 5,000th sheet |
|---|---|---|---|---|---|---|
| Example 1 | A | B | B | C | C | C |
| Example 2 | A | B | B | C | C | C |
| Example 3 | A | A | B | C | C | C |
| Example 4 | A | A | B | C | C | C |
| Example 5 | A | A | A | B | C | C |
| Example 6 | A | A | A | B | B | C |
| Example 7 | A | A | A | A | B | B |
| Example 8 | A | A | A | A | B | B |
| Example 9 | A | A | A | A | B | B |
| Example 10 | A | A | A | A | A | A |

TABLE 2-continued

Results of evaluation on image's white lines

| | Initial | 1,000th sheet | 2,000th sheet | 3,000th sheet | 4,000th sheet | 5,000th sheet |
|---|---|---|---|---|---|---|
| Example 11 | A | A | A | A | A | A |
| Example 12 | A | A | A | A | A | A |
| Example 13 | A | A | A | A | A | A |
| Example 14 | A | A | A | A | A | A |
| Example 15 | A | A | A | A | A | A |
| Example 16 | A | A | A | A | A | A |
| Example 17 | A | A | A | A | A | A |
| Example 18 | A | A | B | C | D | D |
| Example 19 | A | A | A | B | B | C |
| Example 20 | A | A | A | B | B | B |
| Example 21 | A | A | A | A | B | B |
| Example 22 | A | A | B | C | C | D |
| Example 23 | A | A | A | A | B | B |
| Example 24 | A | A | A | A | A | B |
| Example 25 | A | A | A | A | A | A |
| Comparative Example 1 | A | B | C | C | E | E |
| Comparative Example 2 | A | C | D | E | E | E |

TABLE 3

Results of evaluation on image fogging

| | Initial | 1,000th sheet | 2,000th sheet | 3,000th sheet | 4,000th sheet | 5,000th sheet |
|---|---|---|---|---|---|---|
| Example 1 | A | A | B | C | C | C |
| Example 2 | A | A | B | B | C | C |
| Example 3 | A | A | A | B | C | C |
| Example 4 | A | A | A | B | B | C |
| Example 5 | A | A | A | B | B | C |
| Example 6 | A | A | A | A | B | B |
| Example 7 | A | A | A | A | B | B |
| Example 8 | A | A | A | A | B | B |
| Example 9 | A | A | A | A | A | B |
| Example 10 | A | A | A | A | A | A |
| Example 11 | A | A | A | A | A | A |
| Example 12 | A | A | A | A | A | A |
| Example 13 | A | A | A | A | A | A |
| Example 14 | A | A | A | A | A | A |
| Example 15 | A | A | A | A | A | A |
| Example 16 | A | A | A | A | A | A |
| Example 17 | A | A | A | A | A | B |
| Example 18 | A | A | B | B | C | D |
| Example 19 | A | A | A | B | B | C |
| Example 20 | A | A | A | A | B | B |
| Example 21 | A | A | A | A | A | B |
| Example 22 | A | A | A | B | C | D |
| Example 23 | A | A | A | A | A | B |
| Example 24 | A | A | A | A | A | B |
| Example 25 | A | A | A | A | A | A |
| Comparative Example 1 | A | B | C | C | D | E |
| Comparative Example 2 | A | B | C | D | D | E |

TABLE 4

Results of evaluation on image's white lines after recycling of the developer bearing member

| | Initial | 1,000th sheet | 2,000th sheet | 3,000th sheet | 4,000th sheet | 5,000th sheet |
|---|---|---|---|---|---|---|
| Example 1 | A | C | C | C | D | D |
| Example 2 | A | B | C | C | D | D |
| Example 3 | A | B | C | C | D | D |
| Example 4 | A | A | B | C | C | D |

TABLE 4-continued

| | Results of evaluation on image's white lines after recycling of the developer bearing member | | | | | |
|---|---|---|---|---|---|---|
| | Initial | 1,000th sheet | 2,000th sheet | 3,000th sheet | 4,000th sheet | 5,000th sheet |
| Example 5 | A | A | B | B | C | C |
| Example 6 | A | A | B | B | C | C |
| Example 7 | A | A | A | B | B | C |
| Example 8 | A | A | A | B | B | B |
| Example 9 | A | A | A | A | A | B |
| Example 10 | A | A | A | A | A | B |
| Example 11 | A | A | A | A | A | A |
| Example 12 | A | A | A | A | A | A |
| Example 13 | A | A | A | A | A | A |
| Example 14 | A | A | A | A | A | B |
| Example 15 | A | A | A | A | A | B |
| Example 16 | A | A | A | A | A | B |
| Example 17 | A | A | A | A | A | B |
| Example 18 | A | B | C | C | D | E |
| Example 19 | A | A | A | B | B | C |
| Example 20 | A | A | A | B | B | B |
| Example 21 | A | A | A | A | A | B |
| Example 22 | A | B | C | D | D | E |
| Example 23 | A | A | A | A | B | B |
| Example 24 | A | A | A | A | A | B |
| Example 25 | A | A | A | A | A | A |
| Comparative Example 1 | B | C | D | E | E | E |
| Comparative Example 2 | B | D | D | E | E | E |

TABLE 5

| | Results of evaluation on image fogging after recycling of the developer bearing member | | | | | |
|---|---|---|---|---|---|---|
| | Initial | 1,000th sheet | 2,000th sheet | 3,000th sheet | 4,000th sheet | 5,000th sheet |
| Example 1 | A | B | C | D | D | D |
| Example 2 | A | B | B | C | D | D |
| Example 3 | A | A | B | C | D | D |
| Example 4 | A | A | A | B | D | D |
| Example 5 | A | A | A | B | C | D |
| Example 6 | A | A | A | B | C | D |
| Example 7 | A | A | A | B | C | C |
| Example 8 | A | A | A | B | B | C |
| Example 9 | A | A | A | A | B | C |
| Example 10 | A | A | A | A | A | B |
| Example 11 | A | A | A | A | A | A |
| Example 12 | A | A | A | A | A | A |
| Example 13 | A | A | A | A | A | A |
| Example 14 | A | A | A | A | A | B |
| Example 15 | A | A | A | A | A | B |
| Example 16 | A | A | A | A | A | B |
| Example 17 | A | A | A | A | A | B |
| Example 18 | B | C | D | D | D | E |
| Example 19 | A | A | B | B | C | D |
| Example 20 | A | A | A | B | C | C |
| Example 21 | A | A | A | A | B | C |
| Example 22 | B | C | C | D | D | E |
| Example 23 | A | A | A | A | B | C |
| Example 24 | A | A | A | A | A | B |
| Example 25 | A | A | A | A | A | A |
| Comparative Example 1 | B | D | E | E | E | E |

TABLE 5-continued

| | Results of evaluation on image fogging after recycling of the developer bearing member | | | | | |
|---|---|---|---|---|---|---|
| | Initial | 1,000th sheet | 2,000th sheet | 3,000th sheet | 4,000th sheet | 5,000th sheet |
| Comparative Example 2 | B | D | E | E | E | E |

As described above, the one-component magnetic developer of the present invention has a certain relationship between the maximum permeability ($\mu m_A$) of fine magnetic particles (A) contained in toner particles and the maximum permeability ($\mu m_B$) of fine magnetic particles (B) externally added to the toner particles. Thus, the fine magnetic particles (B) as external additives have excellent stability of being attached on the surface of toner particles, so that they can be hardly released therefrom. Therefore, an image with high quality and durability can be obtained even though an image-forming apparatus is miniaturized and capable of processing at a higher speed.

In the one-component magnetic developer of the present invention, fine magnetic particles (B) provided as an external additive is hardly released from the surface of toner particles. Therefore, the amount of the fine magnetic particles (B) attached on the developer bearing member is small, so that, after the use of a process cartridge, the components thereof can be easily recycled.

This invention being thus described, it will be obvious that same nay be varied in various ways. Such variations are not to be regarded as departure from the spirit and scope of the invention, and all such modifications would be obvious for one skilled in the art intended to be included within the scope of the following claims.

This application claims priority from Japanese Patent Application No. 2003-198069 filed Jul. 16, 2003, which is hereby incorporated by reference herein.

What is claimed is:

1. A one-component magnetic toner for developing an electrostatic charge image comprising:

toner particles comprising at least fine magnetic particles (A) and a binder resin; and fine magnetic particles (B) externally added to the toner particles, wherein a maximum permeability ($\mu m_A$) of the fine magnetic particles (A) contained in the toner particles and a maximum permeability ($\mu m_B$) of the fine magnetic particles (B) externally added to the toner particles satisfy a relationship represented by the formula $\mu m_B/\mu m_A \leqq 0.9$ (1).

2. The one-component magnetic toner for developing an electrostatic charge image according to claim 1, wherein a cumulative ratio of the toner particles having particle diameters of 0.6 μm or more to 4 μm or less is 10 to 50% by number.

* * * * *

UNITED STATES PATENT AND TRADEMARK OFFICE

CERTIFICATE OF CORRECTION

PATENT NO. : 7,323,279 B2
APPLICATION NO. : 10/891060
DATED : January 29, 2008
INVENTOR(S) : Kazunori Kato et al.

It is certified that error appears in the above-identified patent and that said Letters Patent is hereby corrected as shown below:

COLUMN 1:

Line 18, “machines.” should read --machines--.

COLUMN 20:

Line 31, “nay” should read --may--.

Signed and Sealed this

Seventh Day of October, 2008

JON W. DUDAS
*Director of the United States Patent and Trademark Office*